US007059220B1

(12) United States Patent
Liou

(10) Patent No.: US 7,059,220 B1
(45) Date of Patent: Jun. 13, 2006

(54) WRENCH COMBINATION

(76) Inventor: Mou-Tang Liou, No. 25, Lane 86, Ta Wei Road, Ta Li City, Taichung Hsien (TW)

( * ) Notice: Subject to any disclaimer, the term of this patent is extended or adjusted under 35 U.S.C. 154(b) by 0 days.

(21) Appl. No.: 10/999,304

(22) Filed: Nov. 29, 2004

(51) Int. Cl.
*B25G 3/38* (2006.01)

(52) U.S. Cl. ..... 81/124.5; 81/177.6; 403/96

(58) Field of Classification Search .... 81/177.5–177.8, 81/124.5, 180.1; 7/100; 403/26, 83, 91, 403/93, 96
See application file for complete search history.

(56) References Cited

U.S. PATENT DOCUMENTS 1,747,527 A * 2/1930 Peterson ..... 81/177.8
4,236,266 A * 12/1980 Hannah et al. ..... 7/100
4,505,171 A * 3/1985 Chang ..... 81/124.5
6,257,103 B1 * 7/2001 Yu ..... 81/177.6
6,257,104 B1 * 7/2001 Jarrett ..... 81/177.8
6,692,178 B1 * 2/2004 Yu ..... 403/85
6,941,842 B1 * 9/2005 Liou ..... 81/124.5

* cited by examiner

*Primary Examiner*—David B. Thomas
(74) *Attorney, Agent, or Firm*—Alan D. Kamrath; Nikolai & Mersereau, P.A.

(57) ABSTRACT

A wrench combination includes a first wrench, a second wrench and a joint for rotationally connecting the first wrench with the second wrench. The first wrench is movably connected with the joint. A socket can be attached to each end of the first wrench. The second wrench is movably connected with the joint. A socket can be attached to each end of the second wrench.

18 Claims, 15 Drawing Sheets

WRENCH COMBINATION

BACKGROUND OF INVENTION

1. Field of Invention

The present invention relates to a wrench combination.

2. Related Prior Art

Referring to FIGS. 13 through 15, a conventional wrench combination includes a first wrench 200 and a second wrench 300. The first wrench 200 includes a shaft 230 and two sockets 210 each formed at an end of the shaft 230. The shaft 230 includes an aperture 220 defined therein and an aperture 221 communicated with the aperture 220. The second wrench 300 includes a shaft 330, a socket 310 formed at an end thereof and a square insert 320 formed at an opposite end thereof. The square insert 320 is used for insertion into a square hole defined in a socket 500. The shaft 330 includes a detent 331 installed thereon. The second wrench 300 is inserted into the first wrench 200 through the aperture 220. On the shaft 330 is formed an annular shoulder 340 for positioning the second wrench 300 relative to the first wrench 200. The first wrench 200 is firmly connected with the second wrench 300 when the detent 331 is pushed into the aperture 220. It is inconvenient for a user to use this conventional wrench combination for two reasons. Firstly, a large space is required for using this conventional wrench combination since the first wrench 200 and the second wrench 300 cannot be pivoted relative to each other. Secondly, the first wrench 200 and the second wrench 300 must be separated from each other for storage. One of the wrenches will be of little use if the other wrench is lost.

The present invention is therefore intended to obviate or at least alleviate the problems encountered in the prior art.

SUMMARY OF INVENTION

A wrench combination includes a first wrench, a second wrench and a joint for rotationally connecting the first wrench with the second wrench. The first wrench is movably connected with the joint. A socket can be attached to each end of the first wrench. The second wrench is movably connected with the joint. A socket can be attached to each end of the second wrench.

The primary advantage of the wrench combination of the present invention is that the first wrench can be pivoted relative to the second wrench so that the wrench combination occupies little space when closed.

Other objects, advantages, and novel features of the invention will become more apparent from the following detailed description when taken in conjunction with the drawings.

BRIEF DESCRIPTION OF DRAWINGS

The present invention will be described through detailed illustration of embodiments referring to the drawings.

DETAILED DESCRIPTION OF EMBODIMENTS

Figure 1:
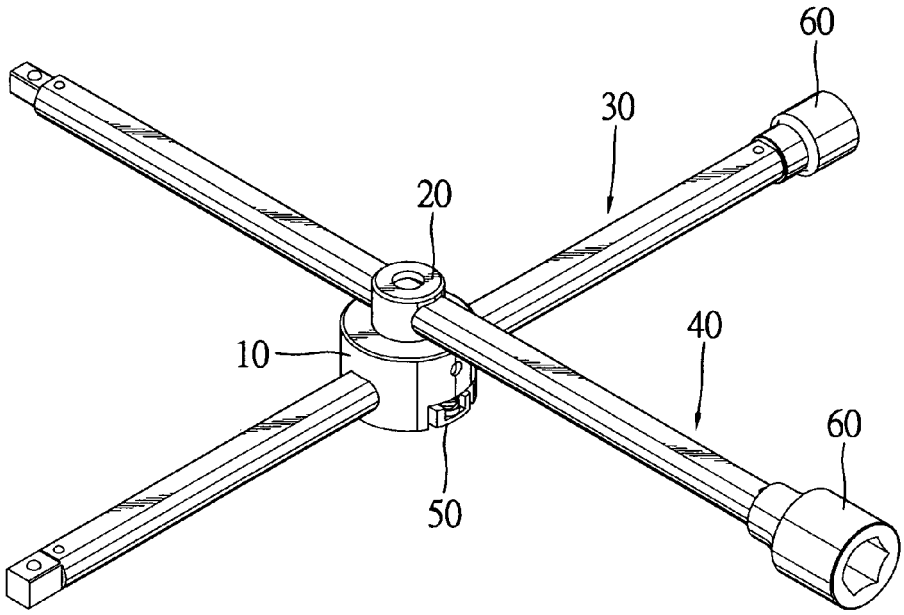
FIG. 1 is a perspective view of a wrench combination according to a first embodiment of the present invention.
Figure 2:
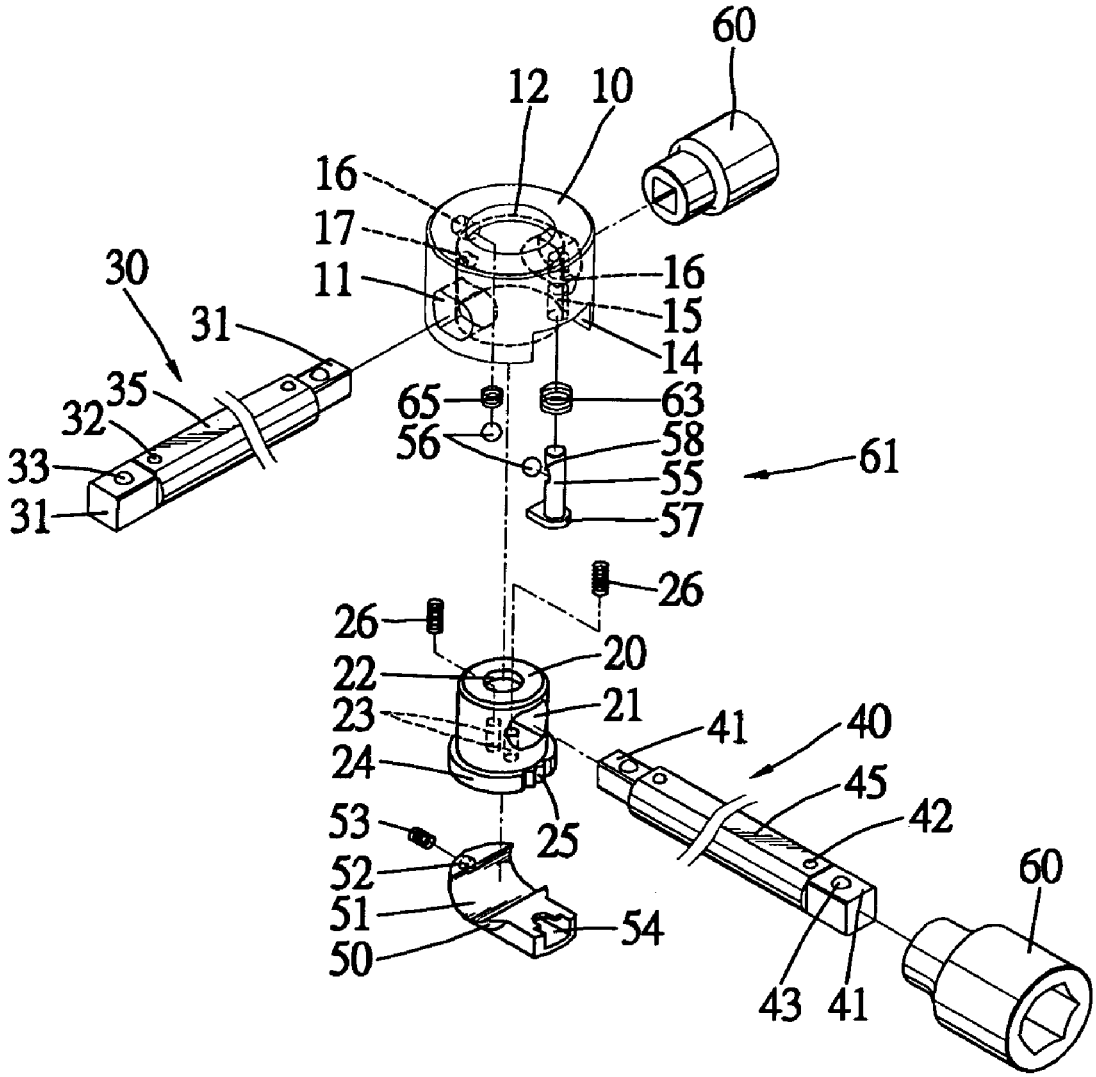
FIG. 2 is an exploded view of the wrench combination shown in FIG. 1.

Referring to FIGS. 1 and 2, according to a first embodiment of the present invention, a wrench combination includes a bearing 10, a first wrench 30, a shaft 20, a second wrench 40 and a cover 50.

The bearing 10 includes a countersink hole 12, two apertures 11 communicated with the countersink hole 12, first and second holes 16 communicated with the countersink hole 12, a recess 17 communicated with the countersink hole 12, a recess 15 defined in a wall thereof and communicated with the first hole 16, and a cutout 14 defined in the wall thereof. The apertures 11 receive the first wrench 30 so that the bearing 10 is not rotational relative to the first wrench 30.

The first wrench 30 is movably inserted through the bearing 10. The first wrench 30 includes a shank 35 and two square inserts 31 each formed at an end of the shank 35. Each of the square inserts 31 can be inserted into a square hole defined in a socket 60. The shank 35 includes many facets. The shank 35 includes two positioning devices 32 each located near corresponding one of the square inserts 31. Each of the square inserts 31 includes a positioning device 33 installed thereon. The positioning devices 32 and 33 each include a ball detent and a spring (not shown). The positioning devices 32 are used for preventing the first wrench 30 from falling from the bearing 10. The positioning devices 33 are used for preventing the sockets 60 from falling from the square inserts 31.

The shaft 20 is pivotally connected with the bearing 10. The shaft 20 includes a first portion extending in the bearing 10 and a second portion extending from the bearing 10. The first portion of the shaft 20 includes a bore 22, an aperture 21 communicated with the bore 22 and two apertures 23 defined in a wall thereof and communicated with the aperture 21 and the bore 22. The second portion of the shaft 20 includes an annular flange 24 formed thereon. The annular flange 24 includes a first group of teeth 25 and a second group of teeth 25 formed thereon. The aperture 21 receives the second wrench 40 so that the shaft 20 is not rotational relative to the second wrench 40. Each of the apertures 23 receives a spring 26 through the bore 22. The springs 26 are compressed between the first wrench 30 and the second wrench 40 so as to prevent the first wrench 30 from sliding relative to the second wrench 40.

The second wrench 40 is movably inserted through the shaft 20. The second wrench 40 includes a shank 45 and two square inserts 41 each formed at an end of the shank 45. Each of the square inserts 41 can be inserted into a square hole defined in a socket 60. The shank 45 includes many facets. The shank 45 includes two positioning devices 42 each located near corresponding one of the square inserts 41. Each of the square inserts 41 includes a positioning device 43 formed thereon. The positioning devices 42 and 43 each include a ball detent and a spring (not shown). The positioning devices 42 are used for preventing the second wrench 40 from falling from the shaft 20. The positioning devices 43 are used for preventing the sockets 60 from falling from the square inserts 41.

The cover 50 is installed on the bearing 10. The cover 50 includes first and second ends. The cover 50 includes a recess 52 defined in the first end thereof, a recess 54 defined in the second end thereof and a cavity 51 defined in a center thereof. The cavity 51 is used for receiving the first wrench 30. The cover 50 is used for preventing dust from entering the bearing 10.

Figure 3:
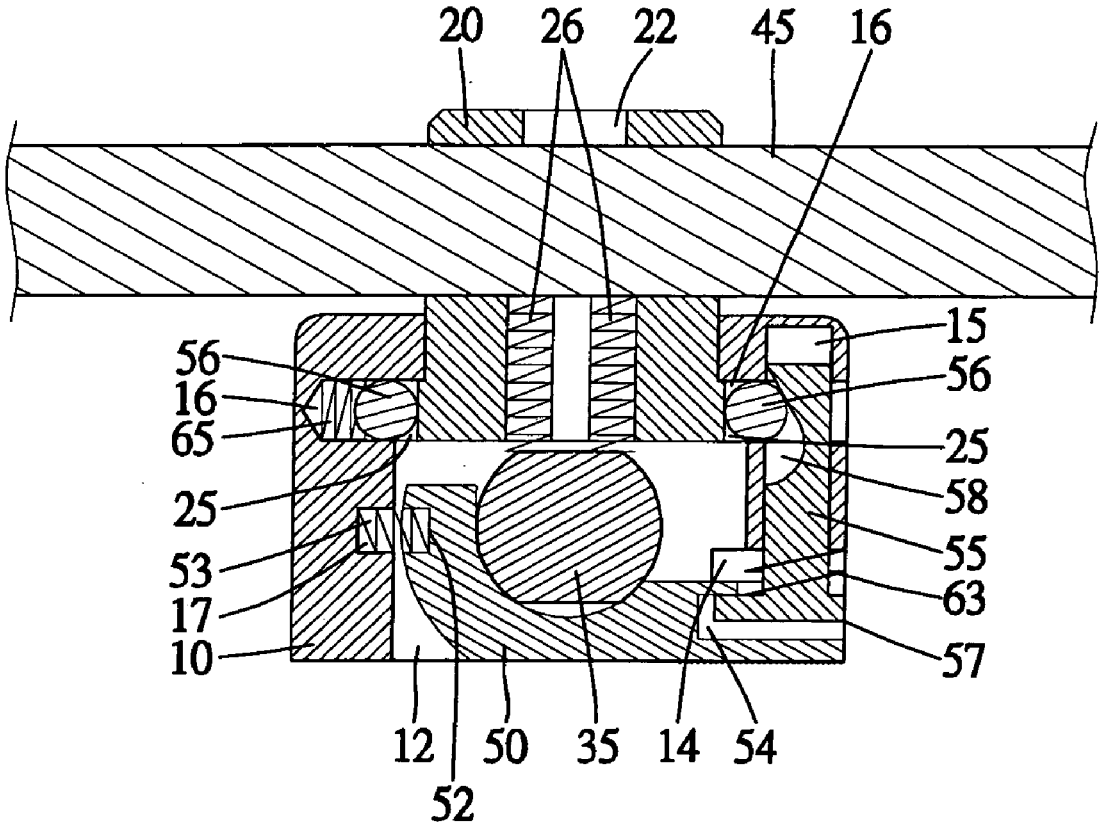
FIG. 3 is a cross-sectional view of the wrench combination of FIG. 1 and shows wrenches of the wrench combination locked to each other.

A controlling device 61 is movably inserted in the bearing 10. The controlling device 61 includes a rod 55, a recess 58 defined in the rod 55 and a tab 57 extending from the rod 55. Referring to FIG. 3, a spring 53 includes an end fit in the recess 52 and another end fit in the recess 17. The tab 57 is put in the recess 54.

Figure 4:
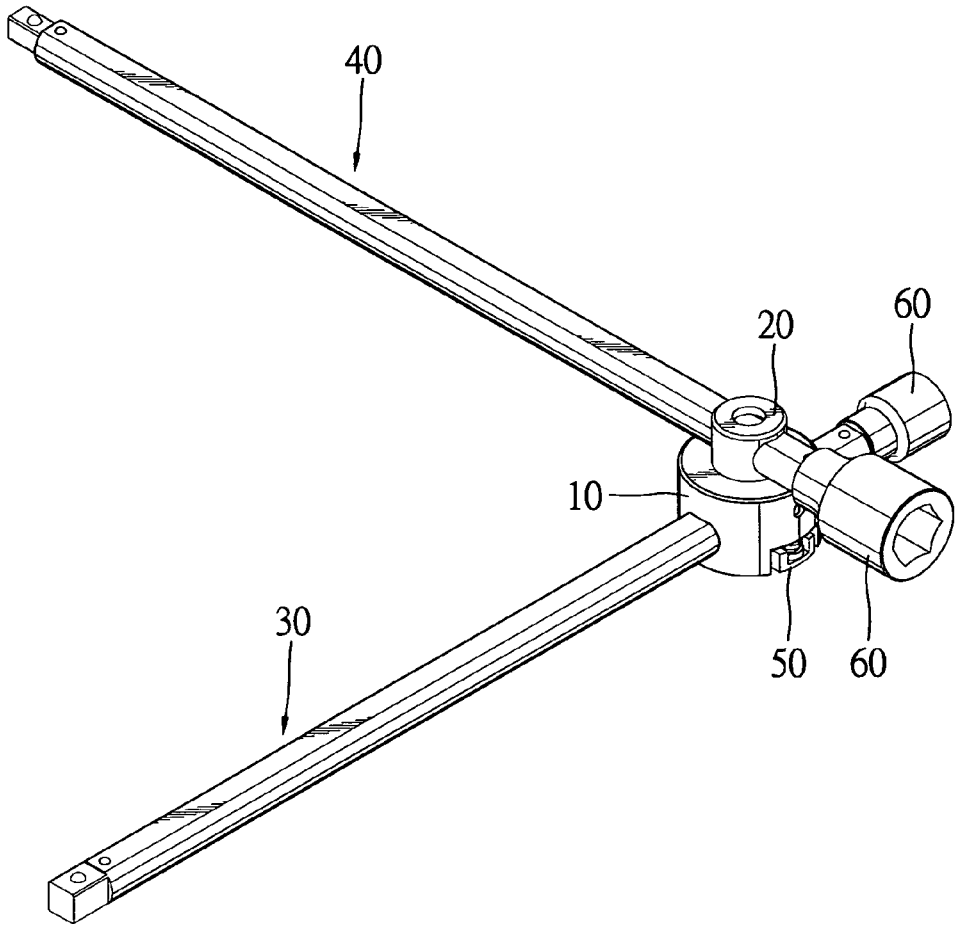
FIG. 4 is similar to FIG. 1 but shows the wrenches in another position relative to each other.

Referring to FIGS. 3 and 4, the first wrench 30 is locked to the second wrench 40. In the cutout 14, a spring 63 is compressed between the bearing 10 and the tab 57. The controlling device 61 is biased downward by the spring 63. A portion of a first ball detent 56 is put in the recess 58. The remaining portion of the first ball detent 56 is pushed toward one of the groups of the teeth 25 by the rod 55. Thus, the first ball detent 56 engages with the teeth 25. A spring 65 is put in the second hole 16 before a second ball detent 56. The spring 65 is compressed between the second ball detent 56 and the bottom of the second hole 16. Therefore, the second ball detent 56 is biased toward the second group of teeth 25 by the spring 65. Thus, the second ball detent 56 engages with the second group of teeth 25. Therefore, the detents 56 can retain the first wrench 30 in position relative to the second wrench 40.

Figure 5:
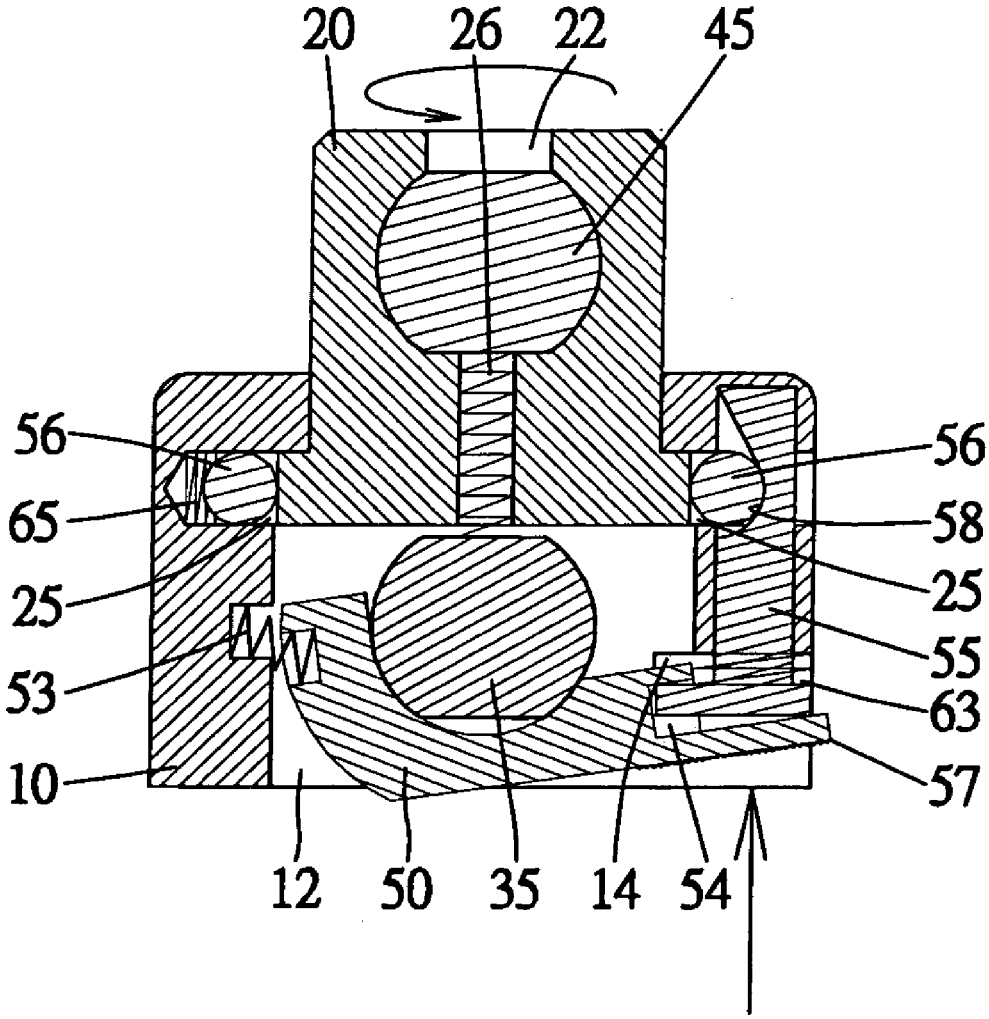
FIG. 5 is similar to FIG. 3 but shows the wrenches of the wrench combination allowed to rotate relative to each other.

Referring to FIG. 5, the first wrench 30 is allowed to rotate relative to the second wrench 40. When a user pushes up the second end of the cover 50, the controlling device 61 is moved upwardly so that the first ball detent 56 is moved further into the recess 58. Thus, the first ball detent 56 is disengaged from the first group of teeth 25. Biased by the spring 65 only, the second ball detent 56 can be disengaged from the second group of teeth 25 as a sufficient torque is exerted.

Figure 6:
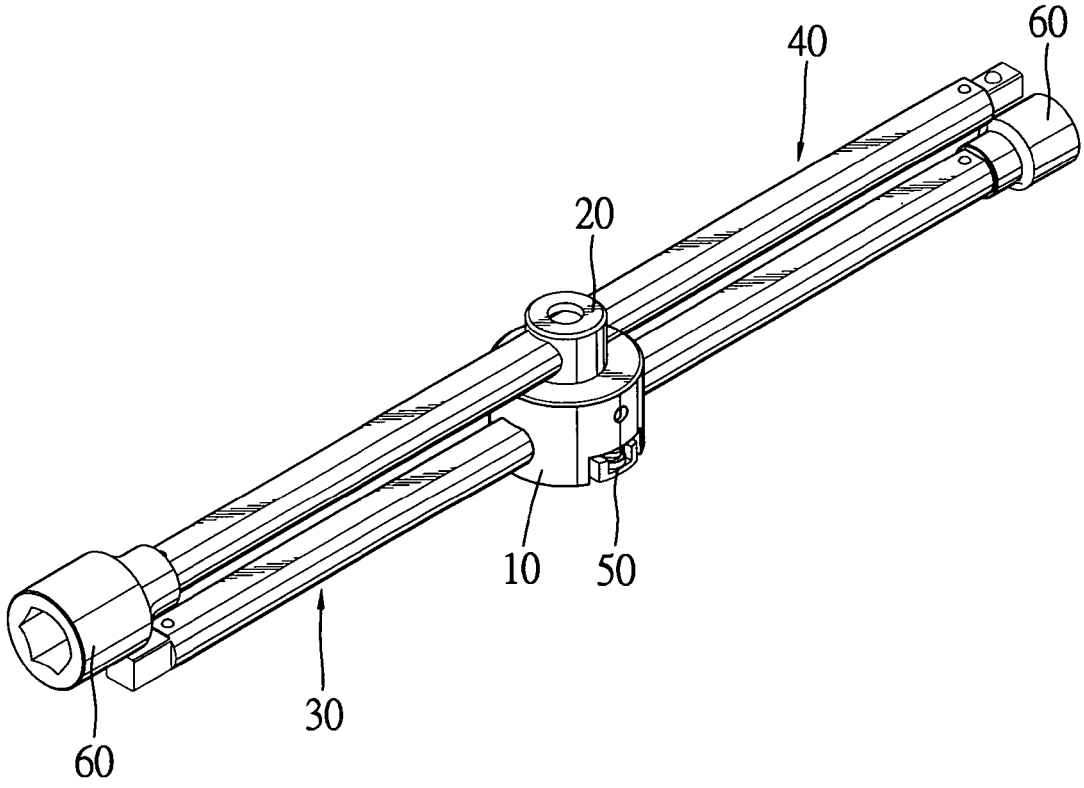
FIG. 6 is similar to FIG. 1 but shows the wrench combination closed.

Referring to FIG. 6, the wrench combination is closed. The first ball detent 56 engages with the first group of teeth 25. The second ball detent 56 engages with the second group of teeth 25. Thus, the detents 56 retain the first wrench 30 in position relative to the second wrench 40.

Figure 7:
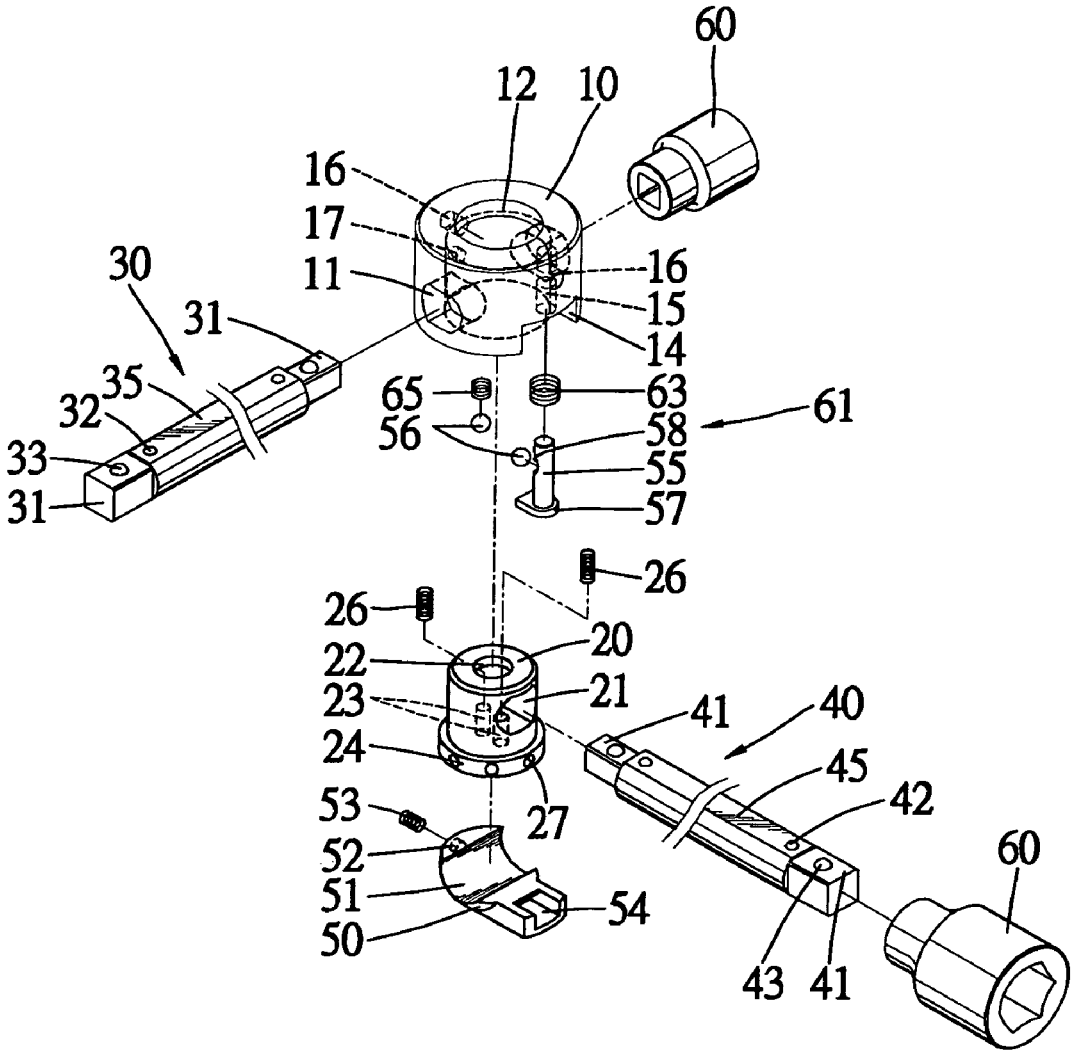
FIG. 7 is an exploded view of a wrench combination according to a second embodiment of the present invention.

FIG. 7 shows a wrench combination according to a second embodiment of the present invention. The second embodiment is identical to the first embodiment except that the annular flange 24 includes two groups of recesses 27 instead of teeth 25.

Figure 8:
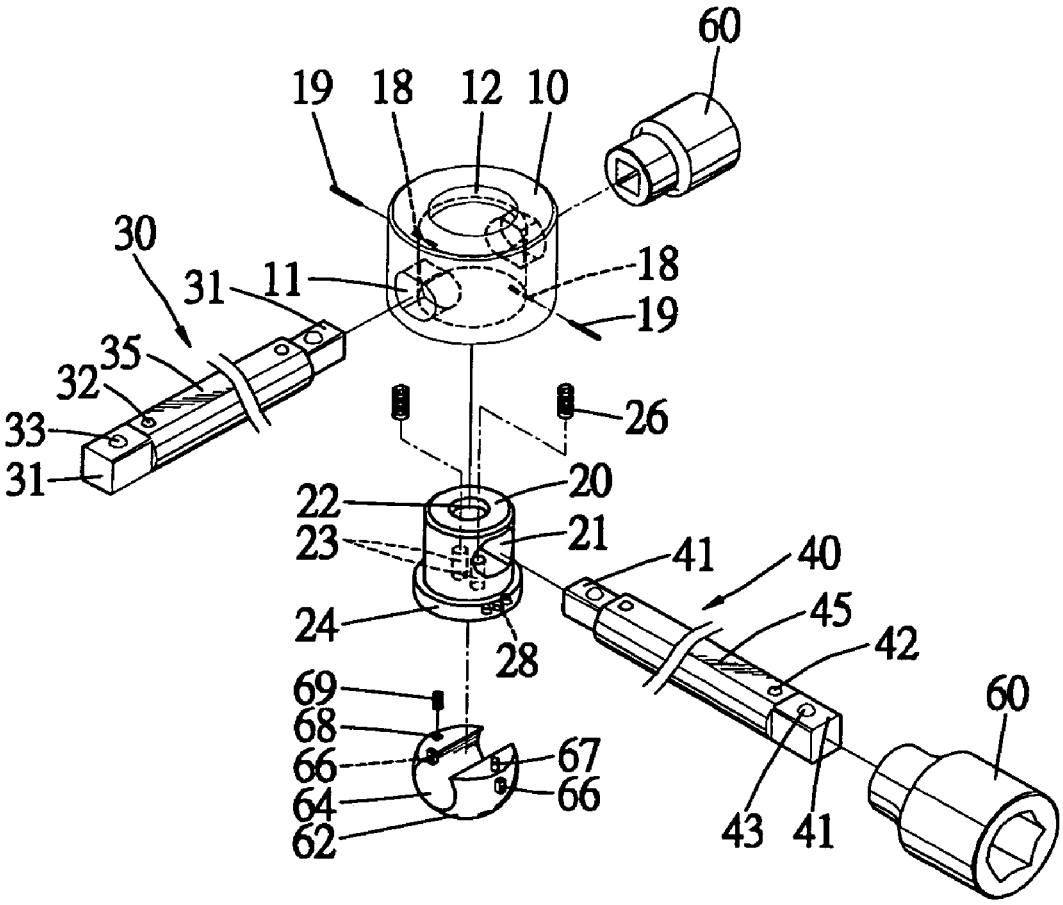
FIG. 8 is an exploded view of a wrench combination according to a third embodiment of the present invention.
Figure 9:
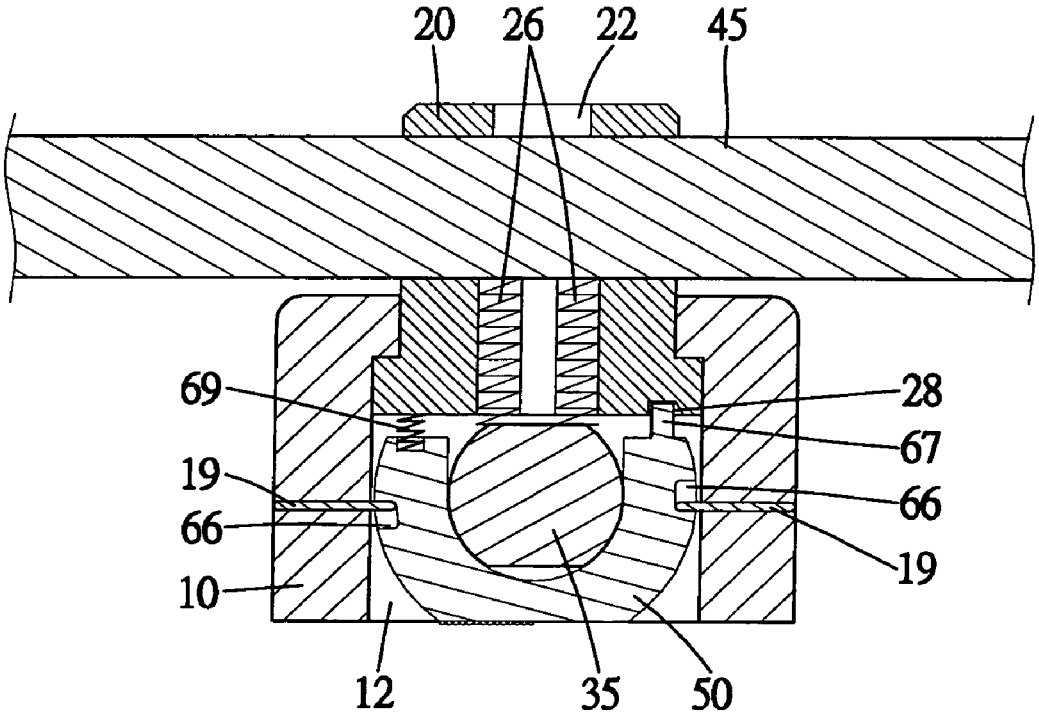
FIG. 9 is a cross-sectional view of the wrench combination of FIG. 8 and shows wrenches of the wrench combination locked to each other.
Figure 10:
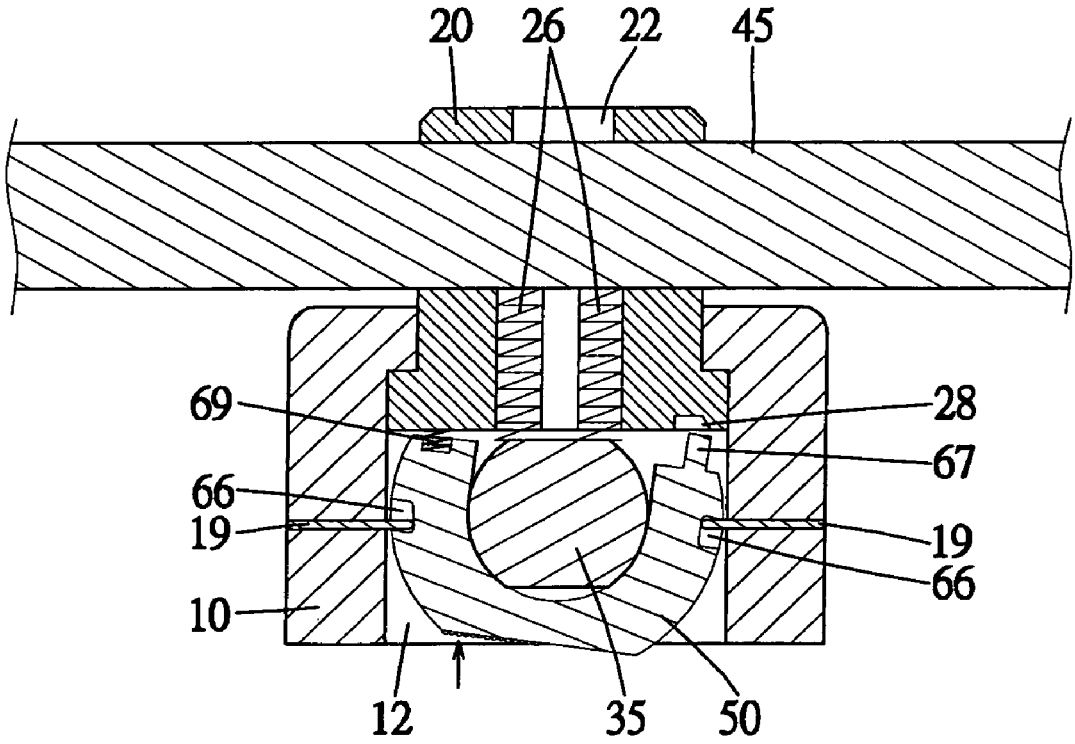
FIG. 10 is similar to FIG. 9 but shows the wrenches allowed to rotate relative to each other.

FIGS. 8 to 10 show a wrench combination according to a third embodiment of the present invention. The third embodiment is identical to the first embodiment except for several things. Firstly, the bearing 10 includes two apertures 18 communicated with the countersink hole 12. Secondly, the holes 16, the recesses 15 and 17 and the cutout 14 are omitted. Thirdly, the annular flange 24 includes two groups of recesses 28 instead of teeth 25. Fourthly, a cover 62 is used instead of the cover 50. The cover 62 includes a cavity 64 for receiving the first wrench 30, a recess 68 defined in an end and a boss 67 formed at another end. The boss 67 can be inserted in one of the recesses 28. A spring 69 includes an end fit in the recess 68 and an opposite end for insertion in one of the recesses 28. The arched side includes a groove 66 near the recess 68 and another groove 66 near the boss 67. Fifthly, a pin 19 is inserted into each groove 66 through a related aperture 18 so that the cover 62 is firmly connected with the bearing 10. Sixthly, the controlling device 61 is omitted.

Referring to FIG. 9, the first wrench 30 is locked to the second wrench 40. The spring 69 is inserted in one of the recesses 28. The boss 67 is inserted into one of the recesses 28 so that the boss 67 can retain the first wrench 30 in position relative to the second wrench 40.

Referring to FIG. 10, the first wrench 30 is allowed to rotate relative to the second wrench 40. When a user pushes up the bottom of the cover 62, the shaft 20 is biased by the spring 69. The boss 67 is disengaged from the recesses 28. Thus, the shaft 20 is not locked to the bearing 10.

Figure 11:
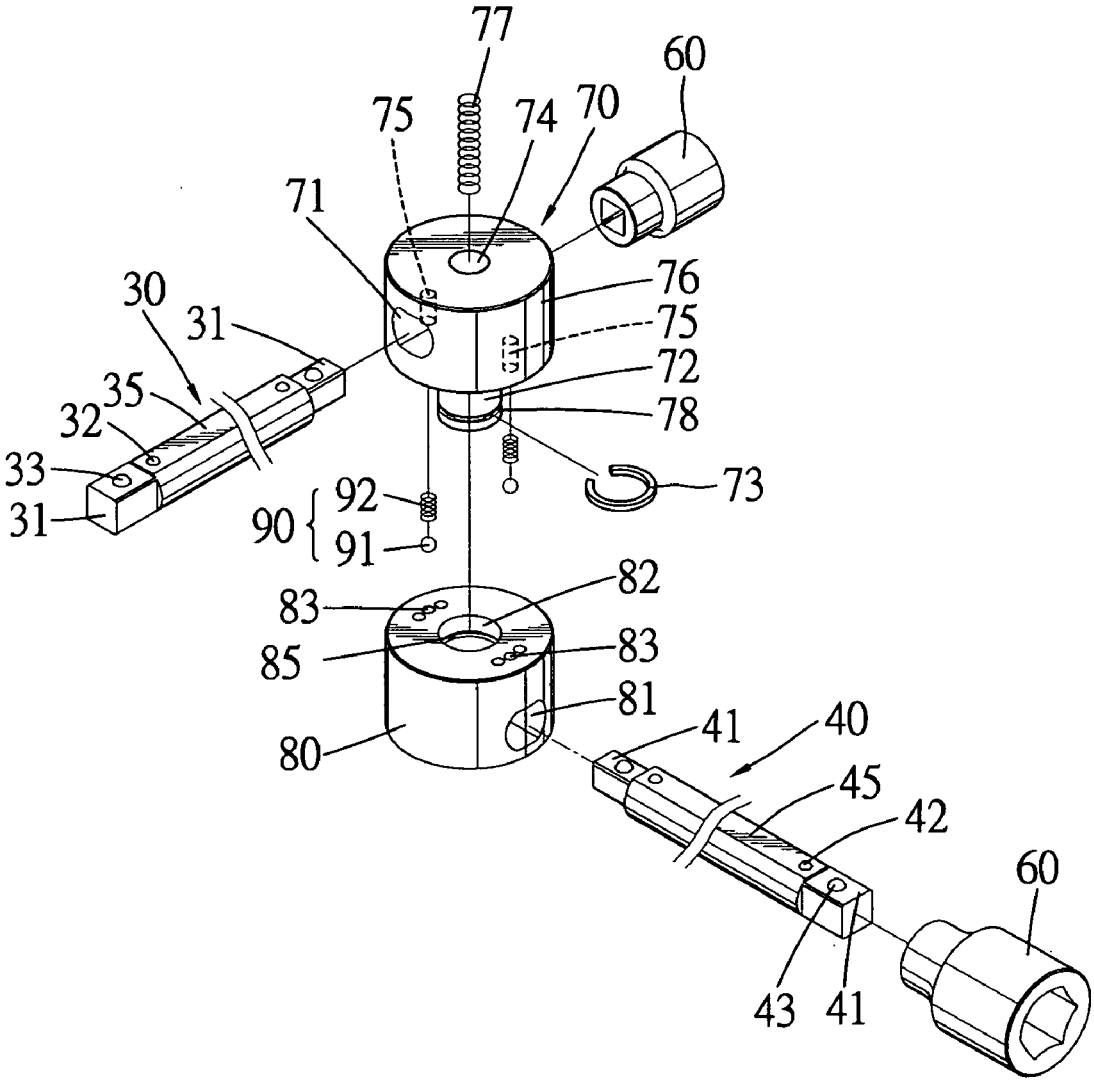
FIG. 11 is an exploded view of a wrench combination according to a fourth embodiment of the present invention.
Figure 12:
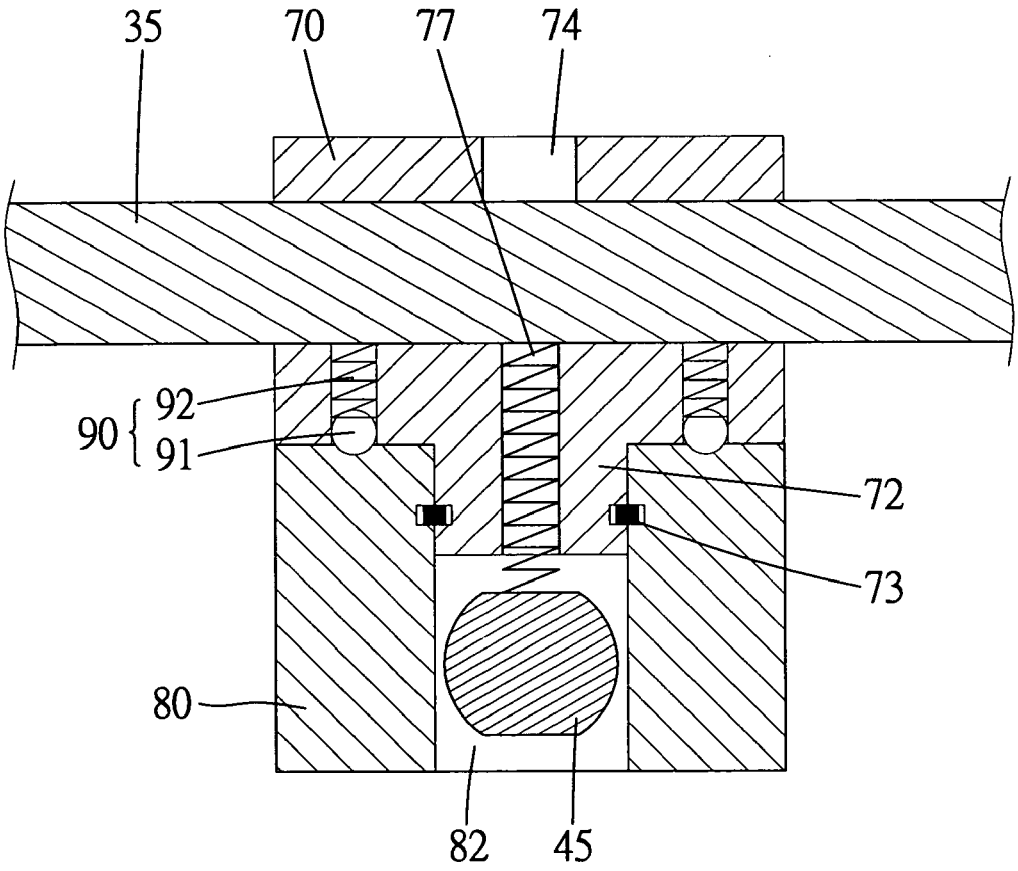
FIG. 12 is a cross-sectional view of the wrench combination of FIG. 11 and shows wrenches of the wrench combination locked to each other.
Figure 13:
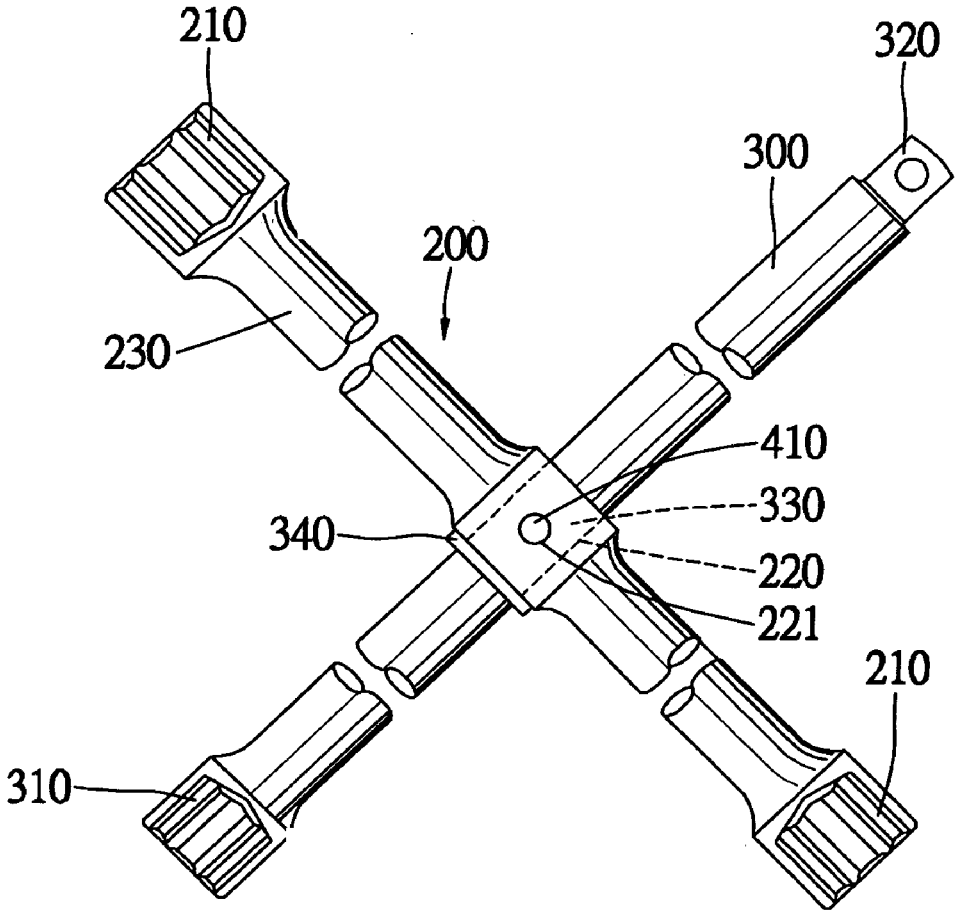
Fig. 13 PRIOR ART
FIG. 13 is a top view of conventional wrench combination.
Figure 14:
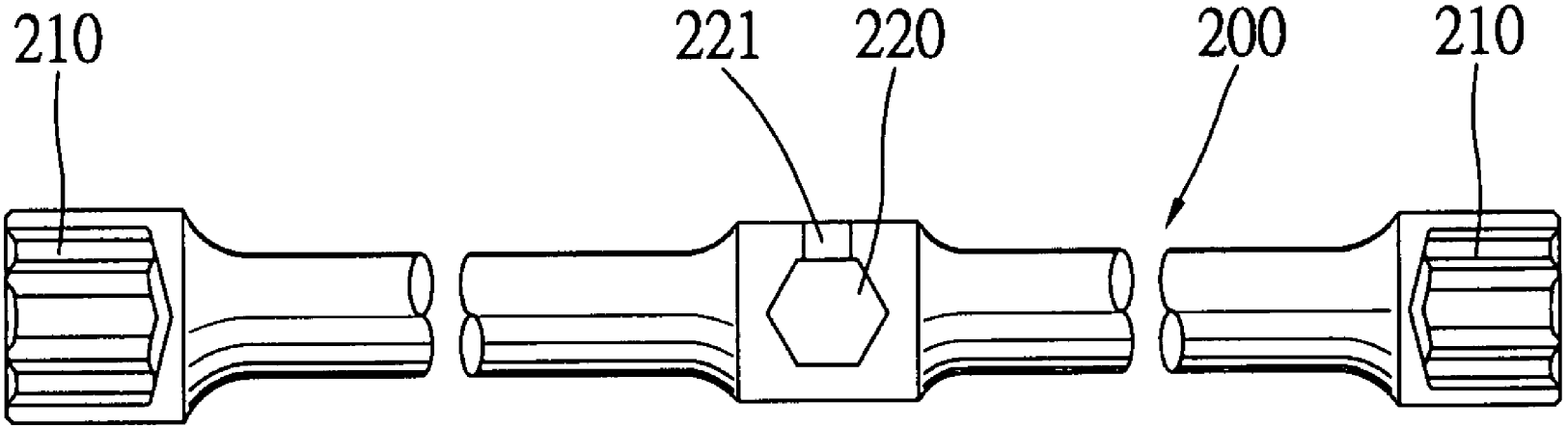
Fig. 14 PRIOR ART
FIG. 14 is a side view of a wrench of the conventional wrench combination of FIG. 13.
Figure 15:
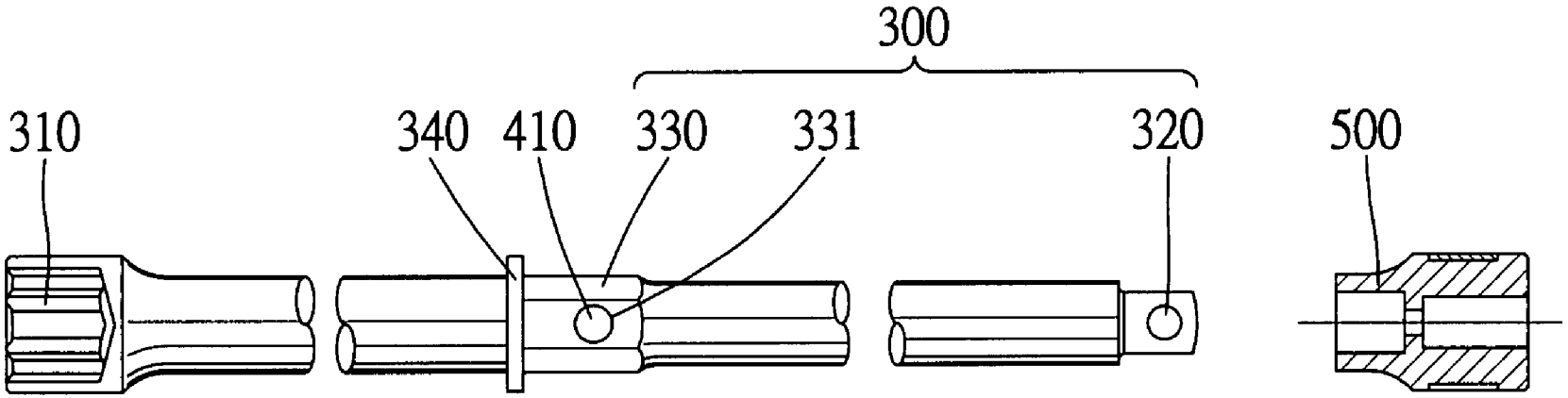
Fig. 15 PRIOR ART
FIG. 15 is a side view of another wrench of the conventional wrench combination of FIG. 13.

FIGS. 11 and 12 show a wrench combination according to a fourth embodiment of the present invention. The fourth embodiment is identical to the first embodiment except for several things. Firstly, a shaft 70 includes a head 76, a body 72 extending from the head 76 and an annular groove 78 defined in the body 72. The head 76 includes an aperture 71, a bore 74 communicated with the aperture 71 and two recesses 75 defined therein. The aperture 71 is used for receiving the first wrench 30. The bore 74 extends through the head 76 and the body 72. Secondly, the bearing 80 includes an aperture 81, a bore 82 communicated with the aperture 81, an annular groove 85 defined in a wall of the bore 82 and two groups of recesses 83 defined in an upper face thereof. The aperture 81 receives the second wrench 40. Thirdly, a positioning device 90 includes a ball detent 91 and a spring 92.

Referring to FIG. 12, the first wrench 30 is locked to the second wrench 40. A C-ring 73 includes an internal edge put in the annular groove 78 and an external edge put in the annular groove 85. Thus, the first wrench 30 is pivotally connected with the second wrench 40. A spring 77 is compressed between the first wrench 30 and the second wrench 40 through the bores 74 and 82 so as to prevent the first wrench 30 from sliding relative to the second wrench 40. The spring 92 is put in the recess 75 before the ball detent 91. The spring 92 is compressed between the ball detent 91 and the recess 75. The ball detent 91 is biased by the spring 92 for engagement with corresponding one of the recesses 83. Therefore, the ball detents 91 can retain the first wrench 30 in position relative to the second wrench 40.

The present invention has been described through detailed illustration of the embodiments. Those skilled in the art can derive variations from the embodiments. The embodiments hence shall not limit the scope of the present invention defined in the claims.

What is claimed is:

1. A wrench combination comprising a first wrench; a second wrench; and a joint rotationally connecting the first wrench with the second wrench, wherein the joint comprises a bearing and a shaft inserted through the bearing, wherein the first wrench is connected with the bearing, wherein the second wrench is connected with the shaft.

2. The wrench combination according to claim 1 comprising a detent for keeping the bearing to the shaft.

3. The wrench combination according to claim 2 wherein the bearing comprises a hole for receiving the detent.

4. The wrench combination according to claim 3 comprising a spring put in the hole of the bearing in order to push the detent.

5. The wrench combination according to claim 3 comprising a controlling device for controlling the detent through the hole.

6. The wrench combination according to claim 5 wherein the bearing comprises a recess communicated with the hole in order to receive the controlling device.

7. The wrench combination according to claim 6 wherein the controlling device comprises a rod movably inserted in the recess and a recess defined in the rod in order to receive the detent.

8. The wrench combination according to claim 7 wherein the controlling device comprises a spring put in the recess of the bearing in order to push the rod.

9. The wrench combination according to claim 8 wherein the controlling device comprises a tab extending from the rod in order to abut the spring.

10. The wrench combination according to claim 7 comprising pivotally connected with the bearing in order to cover and contact the rod.

11. The wrench combination according to claim 2 wherein the shaft comprises at least one group of teeth formed thereon in order to engage with the detent.

12. The wrench combination according to claim 2 wherein the shaft comprises at least one group of recesses defined therein in order to receive the detent.

13. The wrench combination according to claim 1 comprising a cover connected with the bearing.

14. The wrench combination according to claim 13 comprising at least one pin for locking the cover to the bearing.

15. The wrench combination according to claim 13 wherein the cover comprises a boss form thereon, wherein the shaft comprises at least one groove of recesses defined therein in order to receive the boss of the cover.

16. A wrench combination comprising a first wrench; a second wrench; and a joint rotationally connecting the first wrench with the second wrench, wherein the joint comprises a bearing and a shaft inserted through the bearing, wherein the first wrench is connected with the shaft, wherein the second wrench is connected with the bearing.

17. The wrench combination according to claim 16 wherein the shaft comprises a body put in the bearing and a head put out of the bearing for connection with the first wrench.

18. The wrench combination according to claim 17 comprising at least one detent attached to the head of the shaft, wherein the bearing comprises at least one group of recesses for receiving the detent.

* * * * *